United States Patent [19]

Coburn et al.

[11] Patent Number: 5,027,560

[45] Date of Patent: Jul. 2, 1991

[54] MACHINE FOR FINISHING THE SURFACE OF A LENS

[75] Inventors: James M. Coburn, Muskogee; Paul E. Steele, Eufaula, both of Okla.

[73] Assignee: Optical Works Corporation, Muskogee, Okla.

[21] Appl. No.: 496,874

[22] Filed: Mar. 21, 1990

[51] Int. Cl.[5] ..... B24B 7/00; B24B 1/00

[52] U.S. Cl. ..... 51/124 L; 51/60; 51/119; 51/284 R

[58] Field of Search ..... 51/124 L, 60, 58, 150, 51/234, 121, 65, 55, 57, 129, 119, 120, 284 R

[56] References Cited

U.S. PATENT DOCUMENTS 675,055 5/1901 Dourouaux ..... 51/119

2,176,154 10/1939 Shannon ..... 51/58

3,732,647 5/1973 Stith ..... 51/90 X 3,782,042 1/1974 Strasbaugh ..... 51/234 X 4,085,549 3/1978 Hodges ..... 51/58 X 4,862,643 9/1989 Frangel ..... 51/58

*Primary Examiner*—Frederick R. Schmidt

*Assistant Examiner*—Bruce P. Watson

*Attorney, Agent, or Firm*—Head & Johnson

[57] ABSTRACT

A machine for finishing the surface of a lens including a lap holder moved orbitally in a first plane, a lens arm support having a lens holder, the lens arm support being oscillated in a second plane perpendicular to the first plane, the lens arm holder being also simultaneously oscillated in a third plane perpendicular to the first plane, the lens holder being urged toward the lap holder.

9 Claims, 5 Drawing Sheets

MACHINE FOR FINISHING THE SURFACE OF A LENS

SUMMARY OF DISCLOSURE

The present disclosure relates to a machine for polishing a lens, that is, to form a lens to its final surface for use by a wearer. The machine provides a method of polishing a lens in which a lap and a lens are moved relative to each other in paths that are non-repetitious to thereby prevent the formation of grooves, ridges or other aberrations in the lens surface that can occur when repetitious regular or uniform lens finishing motions are utilized.

The use of machines for finishing lenses is a well-known technology and for background information relating to the prior art relevant to this disclosure reference may be had to the following U.S. Pat. Nos. 4,862,644; 3,732,647; 3,552,899; 4,534,137; 4,521,994; 4,135,333; 4,085,594; 4,510,717; 4,320,599; and 3,838,542.

The final polishing of a lens is achieved by moving a lens secured to a lens block against an optical lap. The optical lap has a surface configuration with the desired ultimate shape of the surface of the lens being finished. The lens is normally secured to a block by adhesive, and the block typically has spaced apart pin receiving recesses in the rearward surface that receives pins that are a part of the lens finishing machine by which motion is imparted to the lens block.

The machine of this disclosure employs a base on which the other structures are mounted. The base supports a motor that provides rotational energy imparted to the various elements in the machine. Spaced apart lap drive bearing blocks support lap drive shaft, each shaft having an eccentric at its upper end. A lap holder body has bearings that receive the eccentrics so that the lap holder body is moved in an orbital path. By use of laps secured to the lap holder body, laps are thereby moved in an orbital pattern in a plane parallel to that of the base.

A pair of spaced apart lens arms are supported above the base on a lens arm support assembly. This assembly is simultaneously rotated and laterally displaced about a common axis. The motion of the lens arm support assembly is imparted to lens arms which extend out and over the lap and have pins at the outer end thereof for engaging lens blocks.

Thus the lens finishing machine of this disclosure provides an arrangement wherein laps are orbitally rotated in a horizontal plane and wherein the lens holders are oscillated in two vertical planes, the vertical planes being perpendicular to each other to thereby provide relative motion between the laps and lens block in a compound non-repetitive manner.

A better understanding of the invention will be had by reference to the following description and claims, taken in conjunction with the attached drawings.

DESCRIPTION OF THE PREFERRED EMBODIMENT

Figure 1:
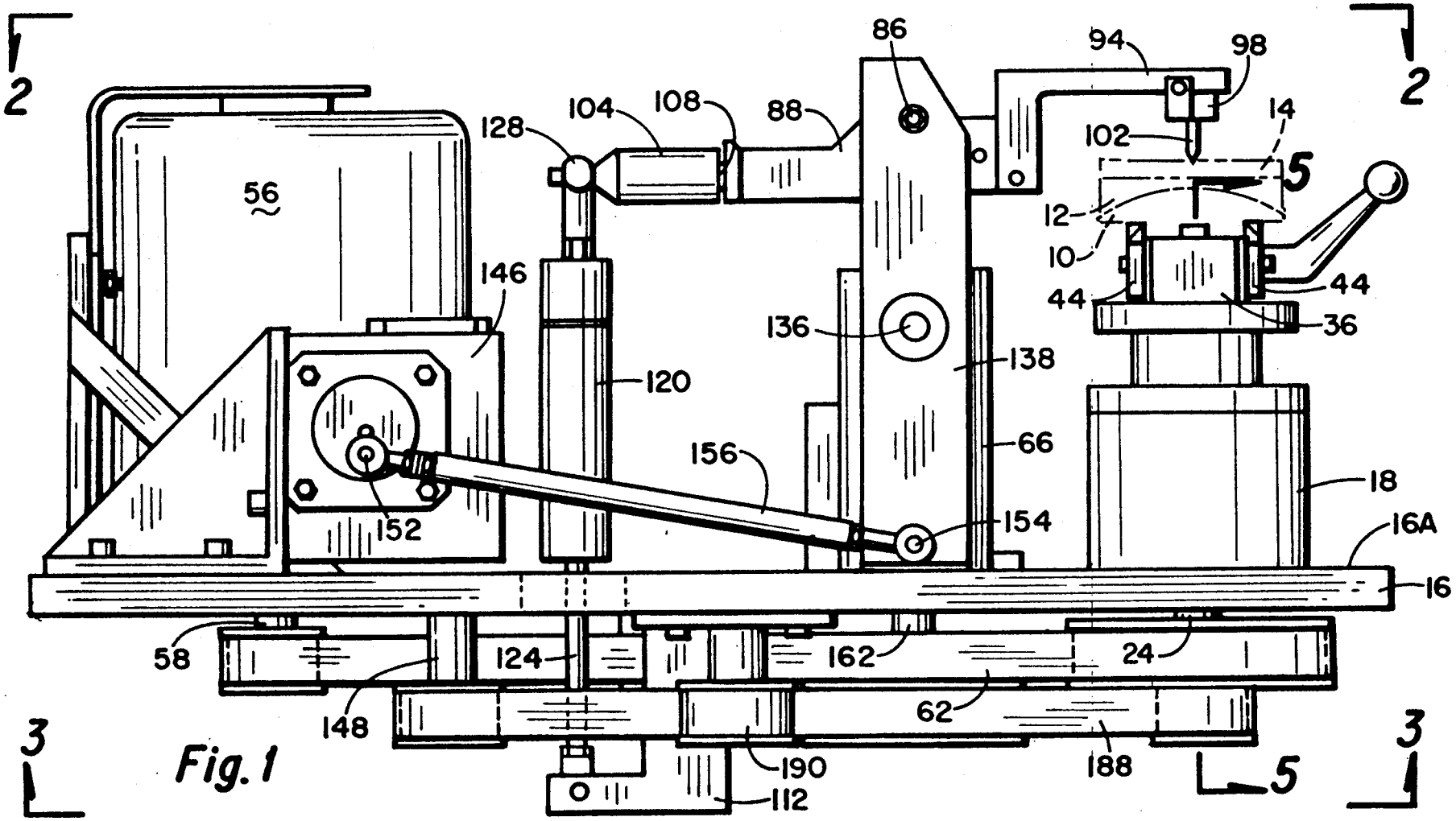
FIG. 1 is an elevational view of the basic elements making up the machine of this disclosure for finishing the surface of a lens in which the elements are mounted on a horizontal base plate. The base plate is normally supported horizontally by a superstructure and cabinet arrangement but such elements are not shown so as to fully view the mechanisms which provide the motions necessary to achieve the finishing of a lens.

Referring first to FIG. 1 of the drawings, a lap is shown in dotted outline and indicated by the numeral 10. The lap is a standard element used in lens finishing and has an external surface defining that desired of the finished lens. Also shown in dotted outline is a lens 12 affixed to a lens block 14. The function of the machine is to move the lens 12 and lap 10 relative to each other so as to grind the surface of the lens to conform to that of the lap. Such movement must be non-repetitious so as to prevent the formation of ridges and grooves and other aberrations in the finished lens surface.

The elements of the machine that provide the desired movement between the lens block 14 and lap 10 are supported to a base plate 16 illustrated as being horizontal and will be described as being horizontal, it being understood that the description of the machine with reference to a horizontal base plate 16 is for purposes of simplicity and not limitative. The machine illustrated and to be described could function as well if the base plate 16 was vertical or at any angle between horizontal and vertical.

Supported to the top surface 16A of the base plate are two lap drive bearing blocks 18 and 20. The preferred embodiment of the machine which incorporates the principles of this disclosure is shown and will be described for use in finishing two lenses simultaneously since such is the normal application, it being understood that a machine which is equipped to finish a single lens would incorporate the same basic principles of the disclosure.

Figure 5:
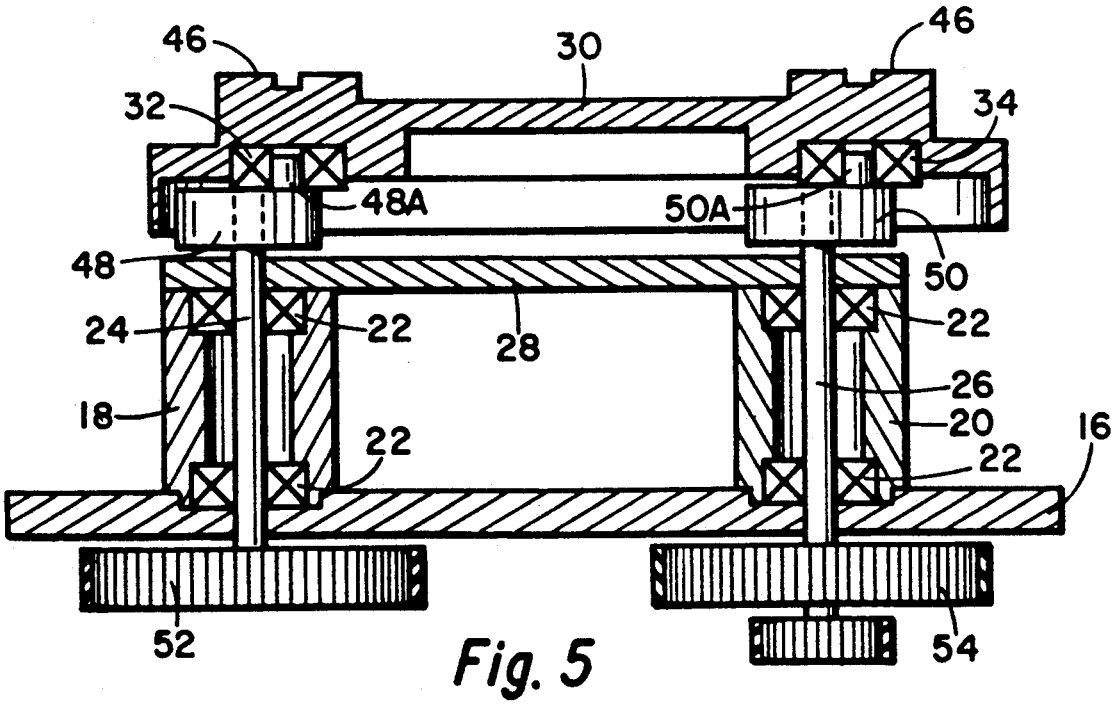
FIG. 5 is a partial cross-sectional view taken along the line 5—5 of FIG. 1 and showing a lap holder body and means for orbitally moving the lap holder body in a plane parallel to that of the base plate.

The lap drive bearing blocks are, as shown in cross-section in FIG. 5, in the form of tubular housing, each supported to and extending upwardly from the base top surface 16A. Each of the bearing blocks 18 and 20 include upper and lower bearings 22 supporting lap drive shafts 24 and 26. Lap drive shafts 24 and 26 are thus supported parallel and spaced apart from each other, and each is supported to rotate about an axis that is perpendicular to the top surface 16A of the base plate.

A plate 28 extends between the tubular lap drive bearing blocks 18 and 20 and is for structural proposes to more rigidly support the bearing blocks, the plate being parallel to the base plate 16.

Figure 4:
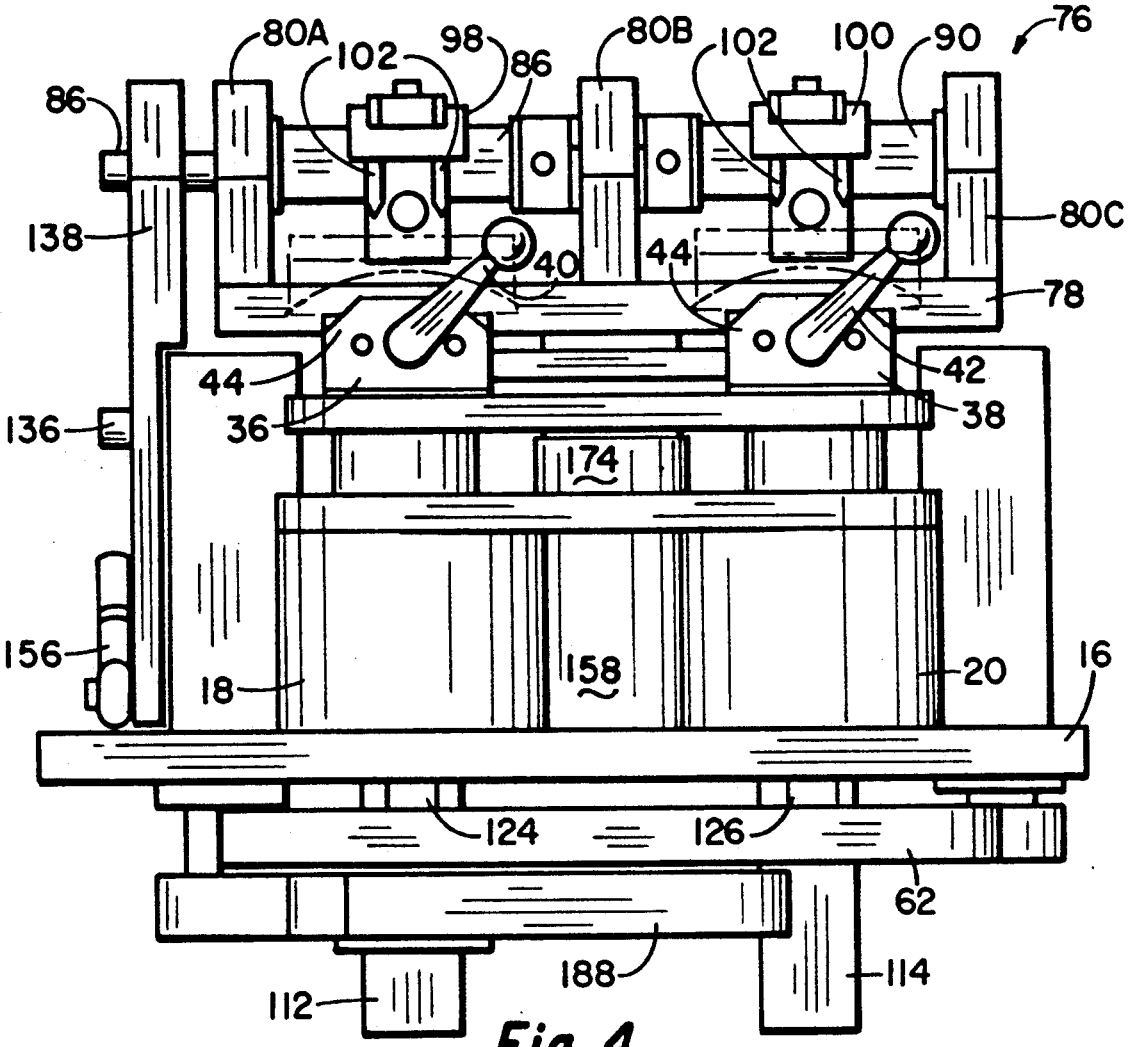
FIG. 4 is a front elevational view of the lens finishing machine of FIG. 1.

Supported above plate 28 is a lap holder body 30 that, as illustrated, is in the form of a machined or cast member which receives, on its lower surface, spaced apart bearings 32 and 34. The top surface of the lap holder body 30 receives lap vices 36 and 38, as shown in FIGS. 1 and 4 but not in FIG. 5. The lap vices each include handle portions 40 and 42 by means of which vice jaws 44 can be moved toward or away from each other to thereby grasp a lap 10 as shown in dotted outline in FIG. 1. Lap vices 36 and 38 are of a known arrangement commonly employed in lens finishing machines to expeditiously provide for removal and replacement of laps as necessary when changing from finishing one set of lenses to a different set of lenses. FIG. 5 shows top surface 46 of the lap holder body 30 that is adaptable to receive lap vices 36 and 38.

As shown in FIG. 5, received on the upper end of each of the lap drive shafts 24 and 26 is an eccentric 48 and 50 respectively. Eccentrics 48 and 50 have eccentric shaft 48A and 50A respectively extending therefrom, these eccentric shafts being received in bearings 32 and 34.

Affixed to the lower end of lap drive shaft 24 below plate 16 is a first lap drive sheave 52 and in like manner, affixed to the lower end of lap drive shaft 26 is a lap drive sheave 54.

Figure 2:
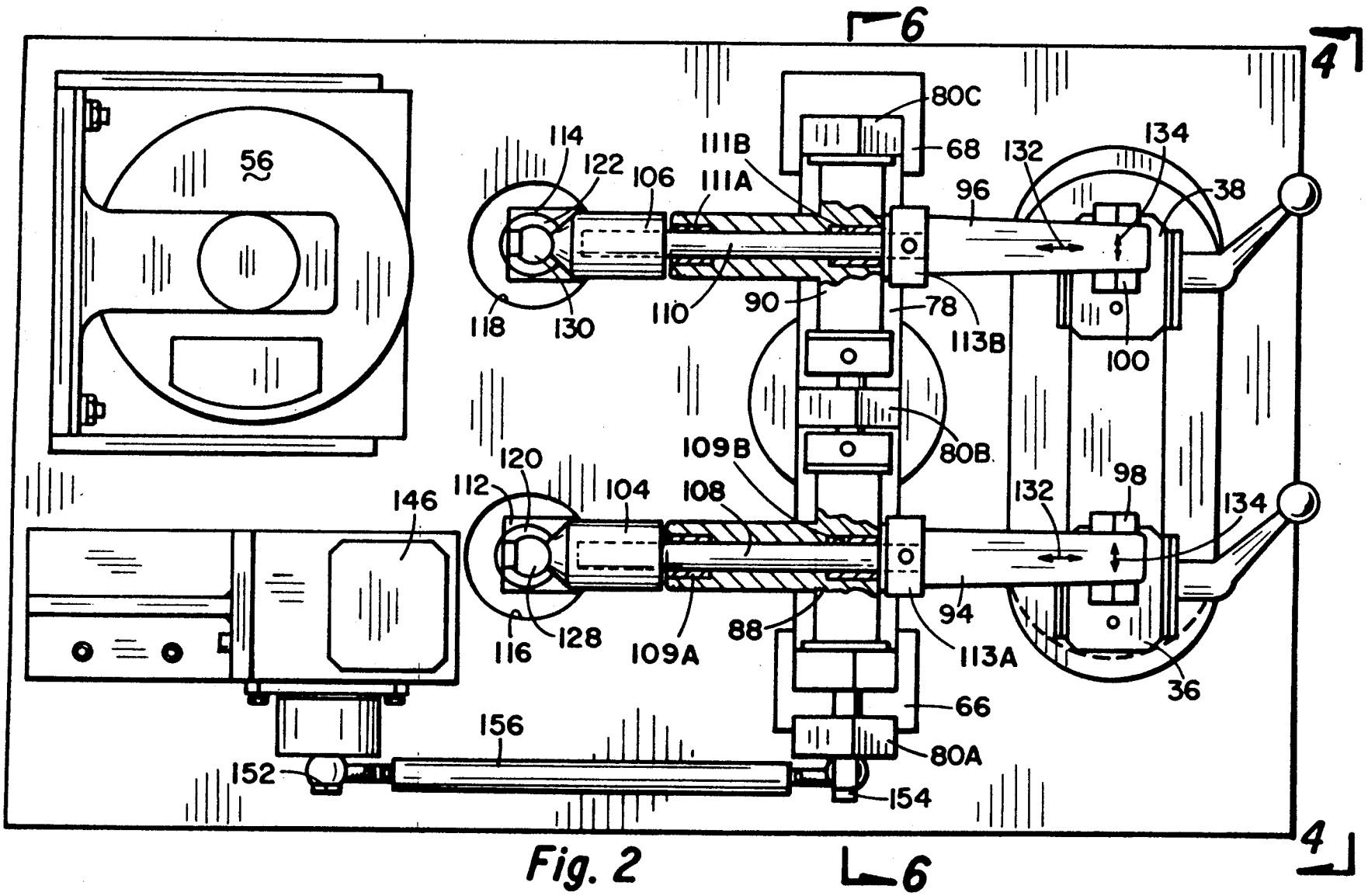
FIG. 2 is a top view of the lens finishing machine of FIG. 1 as taken along the line 2—2 of FIG. 1.
Figure 3:
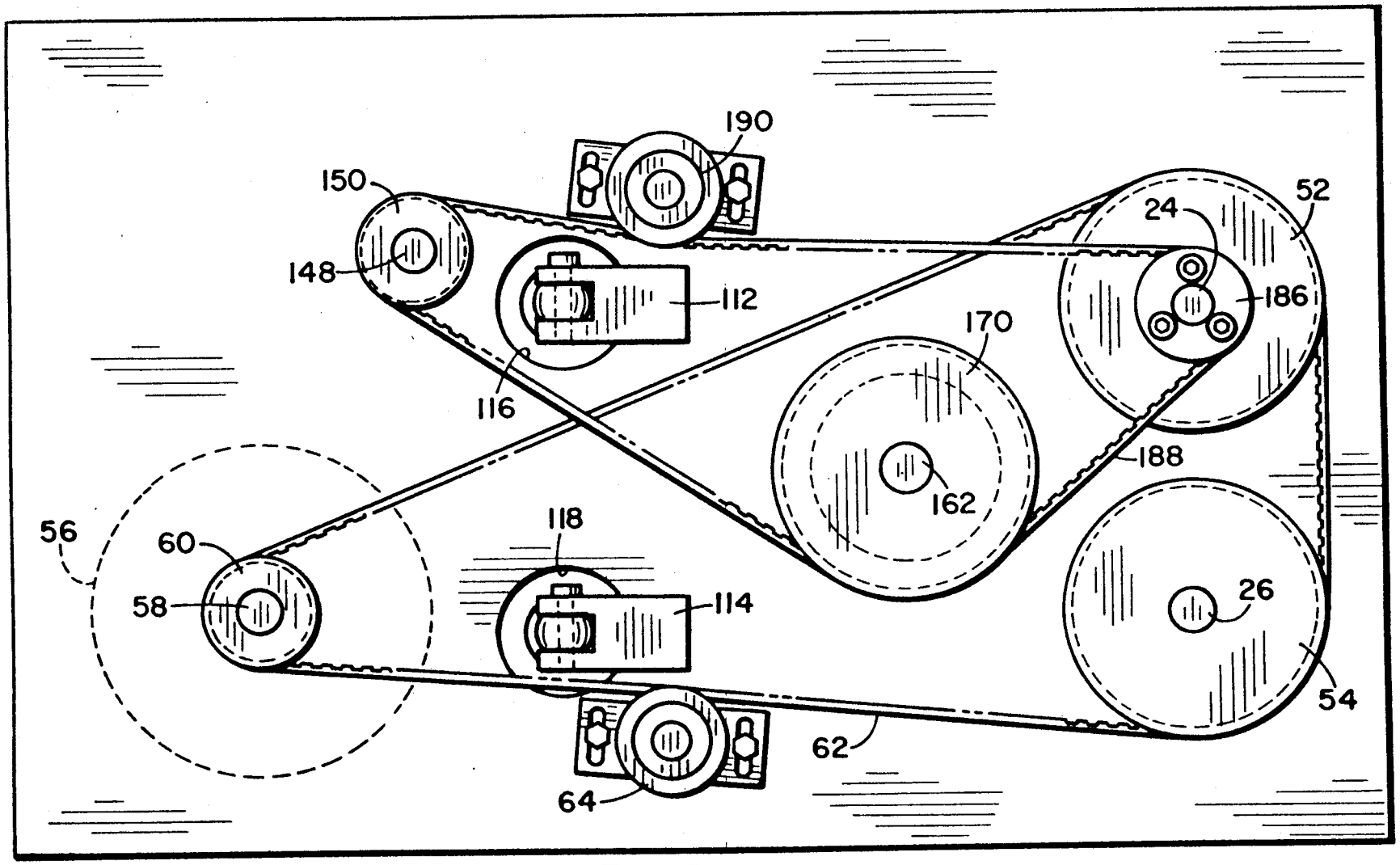
FIG. 3 is a bottom view taken along the line 3—3 of FIG. 1 and showing primarily the pulley and belt arrangement as employed in the machine illustrated in FIGS. 1 and 2.

Referring to FIG. 2, a top view of the machine, there is shown supported on the top of base plate 16 a motor 56. The motor has a shaft 58, as seen in FIG. 1, extending through the base plate 16, and the bottom view of FIG. 3 shows the motor shaft 58 having a primary drive sheave 60 affixed to it. A belt 62 encompasses the primary drive sheave 60 and the lap drive sheaves 52 and 54. The preferred belt, as illustrated in FIG. 3, is of the notched type, and the sheaves 52, 54, and 60 are preferably also notched so that sheaves 52 and 54 remain in synchronization with each other. A take-up reel 64 is mounted on the bottom of the base plate. By adjustable sliding arrangement take-up reel 64 can be moved to take the slack out of belt 62 so as to keep a desired degree of tension in the belt. Other than to provide means of regulating the tension in belt 62, the take-up reel has no function in the lens grinding processes.

With the motor 56 energized, rotating the primary drive sheave 60, the lap drive sheaves 52 and 54 and thereby shafts 24 and 26 are rotated, which imparts an orbital movement to the lap holder body 30. This orbital movement is in a plane parallel the base plate 16 and simultaneously orbitally moves the lap vices 36 and 38 as long as motor 56 is energized.

The method of imparting orbital motion to the lap vises and thereby to laps 10 secured in the vices has been described. Next, the motion imparted to the lens block 14 and thereby lens 12 will next be described, with reference primarily to FIGS. 1, 2 and 6.

Affixed to the top surface of base 16 are two upstanding spaced apart support blocks 66 and 68. Anchor bolts 70 and 72 are received in threaded openings in blocks 66 and 68 respectively. The anchor bolts extend facing each other and in a common axis 74, the axis being parallel to base 16. The anchor bolts 70 and 72 each have an enlarged diameter head portion at the outer end, and the anchor bolts are of smooth cylindrical shape on all portions that are exterior of the threaded openings in the blocks 66 and 68.

Guided on anchor bolts 70 and 72 is a lens arm support assembly, generally indicated by the numeral 76. The lens arm support assembly is formed of a base 78 which is parallel to base 16. Upwardly extending from the lens arm support base 78 are three spaced apart post sections 80A, 80B and 80C. The post sections are parallel to each other, spaced apart and perpendicular to base 16 and have opening 82A, 82B and 82C respectively therein, the openings being in alignment about an axis which is parallel to axis 74. Openings 82A, 82B and 82C receives bushing 84A, 84B and 84C respectively.

Slidably and rotatably received in bushings 84A, 84B and 84C is a lens arm rocker shaft 86. A first lens arm body portion 88 is received on and affixed to rocker shaft 86 between the post sections 80A and 80B. In like manner, a second lens arm body 90 is received on rocker shaft 86 between the post sections 80B and 80C. By means of set screws 92, the lens arm bodies 88 and 90 are locked to shaft 86.

As seen in FIG. 2, lens arm forward portion 94 is affixed to a shaft 108 passing through bushings 109A and 109B in lens arm body 88. In like manner lens arm forward portion 96 is secured to lens arm shaft 110 passing through bushings 111A and 111B in lens arm body 90. The outer end of the lens arms are directly over lap vices 36 and 38.

Each of the lens arm forward portions 94 and 96 have attached to the outer ends thereof lens block engagement member 98 and 100 respectively that include downwardly extended pointed pins 102 configured to engage recesses (not seen) in lens block 14. It can therefore be seen that movement of the lens arm bodies 88 and 90 is transmitted to the lens block 14 positioned over each of the lap vices 36 and 38.

Affixed to shafts 108 and 110 at the rearward ends of arm bodies 88 and 90 are bearing covers 104 and 106. Bearing covers are cylindrical. Two set screws secure each of the bearing covers onto their respective shafts. Set collar 113A and 113B on shafts 108 and 110 are provided to eliminate any play back and forth in arm bodies 88 and 90.

The ability of the lens arms 94 and 96 to pivot in the lens arm supports 88 and 90 allows the same pressure in all the different planes of movement of the lens block 14 and lens 12 in arm supports relation to lap 10.

Affixed to the lower surface of base 16, as seen in FIG. 3, are air cylinder supports 112 and 114, only support 112 being seen in FIG. 1. Through openings 116 and 118 in base 16, air cylinders 120 and 122 are received. Air cylinders have piston rods 124 and 126 respectively extending therefrom, the piston rods being pivotally attached at their lower ends to air cylinder supports 112 and 114. The upper ends of the air cylinders 120 and 122 are pivotally attached respectively to the outer ends of the bearing covers 104 and 106 by means of bearing attachments 128 and 130.

Flexible hoses (not shown) extend to the air cylinders 120 and 122. By means of controllable pressure (not shown) the piston rods 124 and 126 are urged outwardly from the air cylinders to apply upward force on the outer ends of the bearing covers 104 and 106 and apply downward force on the lens block engagement members 98 and 100. By controlling air pressure applied to cylinders 120 and 122, the force of engagement of each lens against each lap 10 is regulated. In addition, by control of air pressure the arm may be pivoted to move the lens block engagement members 98 and 100 in the direction away from the laps 10 to enable the lens and lens blocks to be removed and replaced. The air pressure control systems are not shown in detail since such systems are well-known in the trade of lens grinding equipment for controlling the force of a lens against a lap during lens finishing procedures.

The method by which a lens is held in contact with a lap and the means by which the force of engagement of the lens with the lap have been illustrated. Now the mechanism by which movement of the lens blocks relative to the lens laps will be described. In the lens finishing machine of this disclosure the lenses are moved with reference to the laps simultaneously in two directions, that is, when viewing the machine from above, as in FIG. 2, in a fore and aft direction as indicated by arrow 132 and in a reciprocal lateral direction as indicated by arrow 134. The method of movement of the lens blocks in the fore and aft direction as indicated by arrow 132 will be first described.

Figure 6:
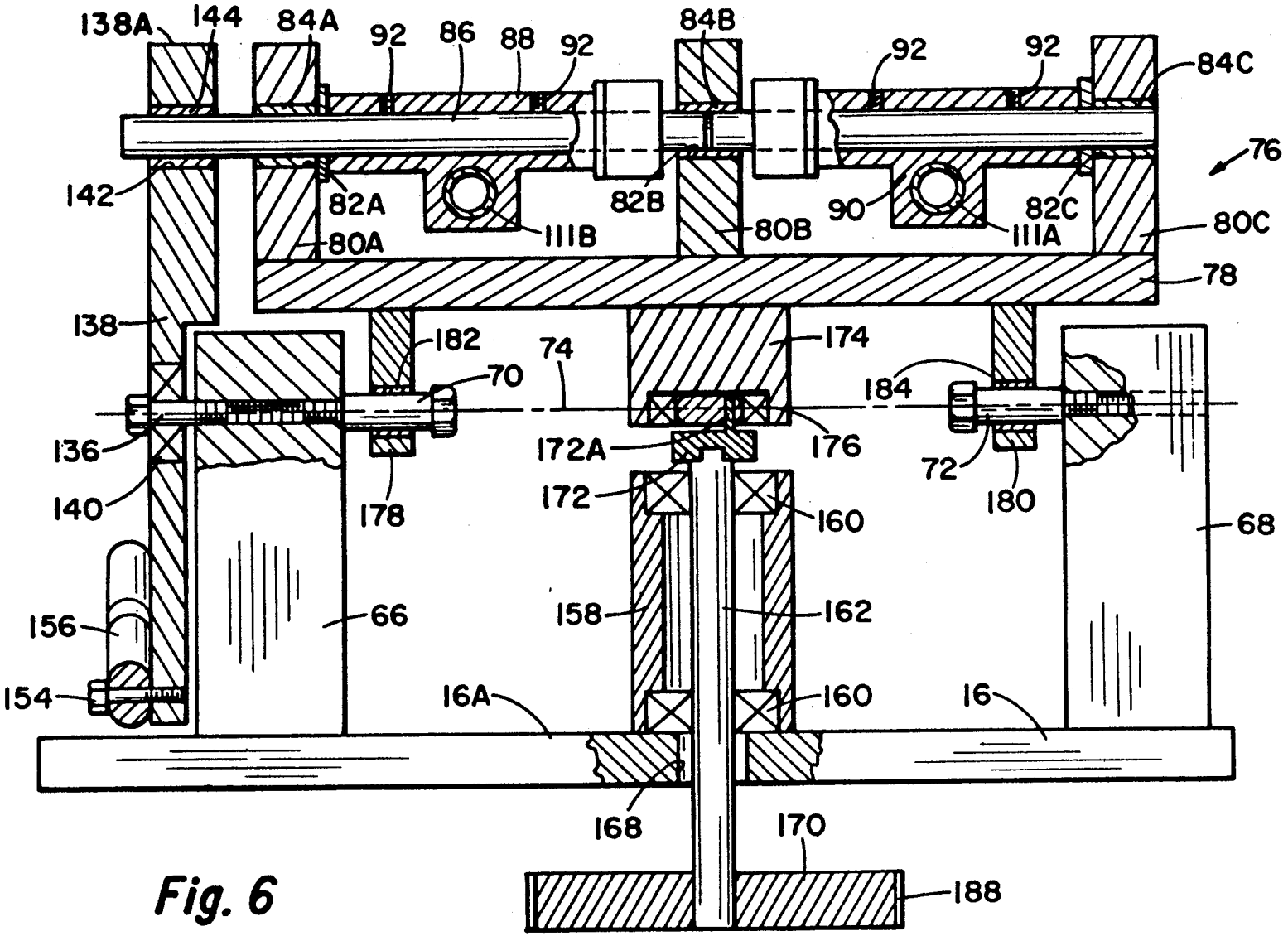
FIG. 6 is a cross-sectional view as taken along the line 6—6 of FIG. 2 showing the basic structures as employed for imparting reciprocal movement of the lens holders in which the lens holders are reciprocated simultaneously in two planes, each plane being perpendicular to each other and each plane being perpendicular to the plane of orbital movement of the lap holder.

As seen in FIGS. 1, 4, and 6, there is, attached to support block 66, a rocker arm post 136 which is in the form of a bolt having a threaded end portion received in the opposite end of the threaded opening that receives anchor bolt 70. The portion extending externally of block 66 is cylindrical with an enlarged diameter head.

Pivotably received on post 136 is a rocker arm 138. More particularly, bearing 140 is received by the rocker arm 138, the bearing, in turn, being received by the rocker arm post 136. Adjacent the upper end 138A of the rocker arm is an opening 142 having a bushing 144 therein. The bushing slidably and rotatably receives lens arm rocker shaft 86.

Referring now to FIGS. 1 and 2, there is positioned on the upper surface 16A of the base a gear box 146. The gear box has a vertical drive shaft 148 that extends through an opening in the base, and the shaft receives a pulley 150, as seen in FIG. 3.

The gear box has a horizontally extending eccentric drive shaft 152. The rocker arm lower end has a drive post 154 in the form of a bolt extending from it. Connecting the eccentric drive shaft 152 and the rocker arm drive post 154 is a pitman 156, the length of which is adjustable. Adjustment of pitman 156 is necessary to center the lens arms 94 and 96 with pins 102 in relation to the center of lens block 14 and lens 12 relative to lap 10.

When the gear box drive shaft 148 is rotated the eccentric drive shaft 152 is thereby simultaneously rotated which moves pitman 156 in a reciprocal manner. This reciprocal motion is transferred to the rocker arm 138 and such motion is thereby transferred to the lens arm rocker shaft 86. This pivotal motion is thereby transferred to the lens arm support assembly 76 and to the lens arm bodies 88 and 90 to thereby produce the fore and aft movement of the lens arm indicated by the arrow 132 in FIG. 2.

Now the method whereby the reciprocal lateral motion is imparted to the lens holders, as indicated by arrow 134 in FIG. 2, will be described.

As seen best in FIG. 6, there is supported to the top surface 16A of the base plate a tubular lens drive bearing block 158 which, in turn, supports upper and lower bearing 160. The bearings receive a lens arm drive shaft 162. The lower end of the lens arm drive shaft extends through an opening 168 within the base plate and has attached to it below the base plate, a lens arm drive sheave 170.

The upper end of the lens arm drive shaft has an eccentric 172 secured thereto with an eccentric shaft 172A extending from it.

Affixed to the bottom surface of the lens arm support assembly base 78 is a bearing housing 174 and positioned within this bearing housing is a rotary pillow block bearing 176. The eccentric shaft 172A is received by bearing 176.

It can be seen that as a lens arm drive shaft 62 is rotated the eccentric 172 imparts a reciprocal motion to the lens arm support assembly 76 that slides back and forth on the anchor bolts 70 and 72. For this purpose, extending from the bottom of the end of arm support assembly base 78 are boss portions 178 and 180, each of which has an opening receiving bushings 182 and 184 therein. These bushings permit the lens arms support assembly 76 to pivot relative to the anchor bolts 70 and 72, and also to slide back and forth along the axis 74 in response to the motion imparted by eccentric 172. This reciprocal lateral direction is conveyed from the lens anchor support assembly 76 to the lens arm bodies 88 and 90 and thereby to the lens block 14.

Referring to FIG. 3, the method of rotating the shafts 148 and 162 is illustrated. Affixed to lap drive shaft 24 below the lap drive sheave 52 is a secondary drive sheave 186. A belt 188, which is preferably notched so as to preserve the rotational relationship between shafts 148 and 160, laps around pulleys 150 and 170.

To maintain the proper tension in belt 188, a take-up reel 190 is secured to the bottom of base 16 and functions in the same way as take-up reel 64 with respect to belt 62.

The lens finishing machine heretofore described provides a means of conveniently supporting an optical lap holder or, specifically, two optical lap holders, and means for providing a rotary motion to the optical lap holders. Simultaneously, the machine provides means of holding lens blocks to thereby position lenses in contact with the laps and in a manner wherein the lens blocks are reciprocated simultaneously in perpendicular directions with respect to the orbiting lap holders. This combined, complex motions of the lap holder and lens block substantially eliminates the possibility of repeated movements of the lens block with respect to the lap holder to thereby ensure that highest quality finishes will be obtained on lenses utilizing the machine.

The claims and the specification describe the invention presented and the terms that are employed in the claims draw their meaning from the use of such terms in the specification. The same terms employed in the prior art may be broader in meaning than specifically employed herein. Whenever there is a question between the broader definition of such terms used in the prior art and the more specific use of the terms herein, the more specific meaning is meant.

While the invention has been described with a certain degree of particularity, it is manifest that many changes may be made in the details of construction and the arrangement of components without departing from the spirit and scope of this disclosure. It is understood that the invention is not limited to the embodiments set forth herein for purposes of exemplification, but is to be limited only by the scope of the attached claim or claims, including the full range of equivalency to which each element thereof is entitled.

We claim:

1. A machine for finishing the surface of a lens with a lap, comprising:

a base;

a lap holder;

means supported by said base to orbitally move said lap holder in a first plane;

a lens holder;

means supported by said base to urge said lens holder toward said lap holder;

means supported by said base to oscillate said lens holder in second planes perpendicular to said first plane; and means supported by said base to oscillate said lens holder in a third plane perpendicular to said first and second planes.

2. A machine for finishing the surface of a lens with a lap according to claim 1 wherein said first plane is substantially parallel to said base and said second and third planes are substantially perpendicular to said base.

3. A machine for finishing the surface of a lens with a lap according to claim 2 wherein said base is substantially in the form of a base plate.

4. A machine according to claim 1 for finishing the surfaces of two lenses with separate laps simultaneously including two said lap holders and lens holders, and wherein said means to orbitally move said lap holder includes means to orbitally move both said lap holders simultaneously, wherein said means to oscillate said lens holder in second planes includes means to oscillate both said lens holders simultaneously and wherein said means to simultaneously oscillate said lens holder in a third plane includes means to simultaneously oscillate both said lens holders in a third plane simultaneously.

5. A machine for finishing the surface of a lens with a lap according to claim 1 wherein said means to orbitally move said lap holder in a first plane includes:

a lap drive shaft rotatably supported by said base;

a lap holder body;

an eccentric affixed to said lap drive shaft and coupled to said lap holder body; and means to rotate said lap drive shaft.

6. A machine for finishing the surface of a lens with a lap according to claim 1 wherein said means to oscillate said lens holder in a second plane perpendicular to said first plane includes:

a lens arm holder mounted to said base in sliding arrangement in a plane parallel to said first plane;

a lens actuator arm pivotally affixed to said lens arm holder and having an outer end adaptable to engage said lens holder;

a lens arm drive shaft rotatably supported by said base;

an eccentric affixed to said lens arm drive shaft and means coupling said eccentric to said lens arm holder; and means to rotate said lens arm drive shaft.

7. A machine for finishing the surface of a lens with a lap according to claim 6 wherein said means to oscillate said lens holder in a third plane wherein said lens arm holder is mounted to said base in both pivoting and sliding arrangement, comprising:

a rocker arm pivotally supported to said base and having one end thereof pivotally secured to said lens arm holder at a point displaced from said point of pivotation;

a motor driven crank arm supported to said base; and a pitman member pivotally extending from said crank arm to said rocker arm.

8. A machine for finishing the surface of a lens with a lap according to claim 1 wherein said means to oscillate said lens holder in a second plane includes sliding means along an axis with respect to said base and wherein said means to oscillate said lens holder in a third plane including pivoting means about said axis.

9. A machine for finishing the surface of a lens with a lap according to claim 7 wherein said means coupling said eccentric to said lens arm holder includes bearing means permitting rotation and oscillator movement between said eccentric and said lens support.

* * * * *